US006102602A

United States Patent [19]

Kageyama et al.

[11] Patent Number: 6,102,602

[45] Date of Patent: Aug. 15, 2000

[54] LIQUID CONTAINER CAP

[75] Inventors: Hidehei Kageyama; Yoshio Noguchi; Tomohiro Fueki, all of Kawagoe, Japan

[73] Assignee: Kotobuki Printing Co., Ltd., Kyoto, Japan

[21] Appl. No.: 09/387,267

[22] Filed: Aug. 31, 1999

[30] Foreign Application Priority Data

Mar. 15, 1999 [JP] Japan ..... 11-069311
Aug. 9, 1999 [JP] Japan ..... 11-225811

[51] Int. Cl.[7] ..... A46B 17/04

[52] U.S. Cl. ..... 401/269; 401/202

[58] Field of Search ..... 401/269, 202, 401/243, 245, 246, 247, 262, 124

[56] References Cited

U.S. PATENT DOCUMENTS 2,673,362 12/1954 Robinson ..... 401/269
3,475,103 10/1969 Danjczek ..... 401/243
4,627,757 12/1986 Manusch et al. ..... 401/269

*Primary Examiner*—David J. Walczak
*Attorney, Agent, or Firm*—McGinn & Gibb, P.C.

[57] ABSTRACT

A cap adaptable to the prevention of the application tip body of a liquid container from being dried up by supplying a vaporized solvent thereto, characterized in that it is configured in such a manner that its supply of solvent is difficult to obstruct.

When the cap is attached to the liquid container, since the tip of the brush of the liquid container is inserted into the inside space of the inner cap and the tip fitting of the liquid container biases the opening/closing member toward the innermost portion of the cap body against the energizing force of the spring, the transverse hole of the cylindrical portion communicates with the innermost portion of the cap body, which allows the vaporized solvent out of the solvent-impregnation medium to pass through the transverse hole, the longitudinal hole and the solvent passage, and around the flange portion of the inner cap, thus the solvent reaches the brush of the liquid container, as a result, the brush is moistened and prevented from being dried up. Even in the case where the viscous liquid springs out from the brush, the viscous liquid will scatter within the inner cap alone.

13 Claims, 11 Drawing Sheets

LIQUID CONTAINER CAP

BACKGROUND OF THE INVENTION

1. Field of the Invention

This invention relates to a cap adapted to being attached to a liquid container which receives viscous liquid such as cosmetic nail polish, correction fluid and so on and has on its tip portion an application tip body for applying the viscous liquid.

2. Description of the Related Art

There is described a liquid container cap of this type in Japanese Utility Model Publication NO. 2521936 which comprises: a cap body, a housing portion defined inside a tip of the cap body via a partition member, a solvent-impregnation medium housed in the housing portion, liquid-flowing means provided almost centrally on the partition member for flowing the solvent out of the solvent-impregnation medium from the housing portion downwardly inside the cap, an opening/closing mechanism disposed downwardly inside the cap for opening/closing the liquid-flowing means, and energizing means disposed between the partition member and the opening/closing mechanism. When the cap is detached from the liquid container, the energizing means works to energize the opening/closing mechanism toward the liquid-flow closing position, as a result of which the solvent out of the solvent-impregnation medium is prevented form vaporizing and flowing out. On the other hand, when the cap is attached to the liquid container, the energizing means shrinks and moves the opening/closing mechanism toward the liquid-flow opening position, which allows the vaporized solvent out of the solvent-impregnation medium to flow out toward the application tip body of the liquid container, as a result, the application tip body is prevented from being dried up.

However, in such a conventional liquid container cap, since the opening/closing mechanism is composed of, in particular, through-holes and the like which communicate with the space where the application tip body of the liquid container is housed, in the cases where the viscous liquid springs out from the application tip body of the liquid container with the cap being attached thereto, the through-holes or the like are likely to be clogged with the viscous liquid and blocked up thereby.

SUMMARY OF THE INVENTION

The present invention was made in light of the above difficulty. Accordingly, it is an object of the present invention to provide a liquid container cap such that, while it is attached to a liquid container, its supply of vaporized solvent is not obstructed.

In order to attain the above object, there is provided, according to the present invention, a liquid container cap adapted to be detachably attached to a tip portion of a liquid container which receives viscous liquid and has on its tip an application tip body for applying the viscous liquid and designed to protect the above application tip body, comprising: a cap body, a solvent-impregnation medium impregnated with a solvent and housed in an inner side portion of an inside of the cap body for preventing the above application tip body from being dried up, a partition member fixed within the cap body for dividing the above solvent-impregnation medium from an open side portion of the cap body, a solvent flowing-out means provided radially almost centrally in the above partition member for letting the vaporized solvent out of the solvent-impregnation medium flow out, an opening/closing member disposed within the open side portion of the cap body for opening/closing the above solvent flowing-out means, energizing means for always energizing the opening/closing means in such a direction as to close the solvent flowing-out means, and an inner cap fixed inside the above opening/closing member, wherein a solvent passage through which the vapored solvent from the above solvent flowing-out means passes is formed between the external surface of the above inner cap and the internal surface of the above opening/closing member, further a second solvent passage via which the above solvent passage and the above application tip body communicate with each other is formed between the external and internal surfaces of the inner cap, and when the cap is attached to the liquid container, the liquid container biases the above opening/closing member in such a direction as to open the above solvent flowing-out means, while the above application tip body being inserted into the above inner cap, as a result of which the vaporized solvent out of the solvent-impregnation medium is allowed to pass through the solvent flowing-out means, the above solvent passage and the second solvent passage, so as to reach the application tip body.

When the cap is detached from the liquid container, since the energizing means works to bias the opening/closing member in such a direction as to close the solvent flowing-out means, the solvent is prevented from vaporizing and flowing out of the solvent-impregnation medium. On the other hand, when the cap is attached to the liquid container, since the liquid container pushes the above opening/closing member in such a direction as to open the above solvent flowing-out means, the vaporized solvent out of the solvent-impregnation medium is allowed to pass through the solvent flowing-out means, the solvent passage formed between the opening/closing member and the inner cap, and the second solvent passage formed between the external and internal surfaces of the inner cap, so as to reach the application tip body, as a result of which the application tip body is moistened and prevented from being dried up. Since the application tip body is inserted into the inner cap, the viscous liquid having sprung out from the application tip body may scatter mostly within the inner cap, but will never reach the solvent flowing-out means nor the solvent passage, and therefore, never clog them. The second solvent passage may be prevented from being clogged with the viscous liquid having sprung out from the application tip body by increasing its cross-sectional area or by locating it to the liquid container side away from a base portion of the application tip body.

The above second solvent passage may be a periphery of a flange portion of the inner cap. The second solvent passage can be prevented from being clogged with the viscous liquid by adapting the flange portion of the inner cap for the above second solvent passage, consequently the vapored solvent out of the solvent-impregnation medium can pass through the solvent flowing-out means, the solvent passage formed between the opening/closing member and the inner cap, and around the flange portion of the inner cap, and finally reach the application tip body.

Further, the flange portion of the above inner cap may spread radially outwardly. When the application tip body is inserted into the inner cap with the cap attached to the tip portion of the liquid container, the application tip body is prevented from interfering with the flange portion of the inner cap, and from being damaged.

Alternatively, the above second solvent passage may be an opening formed in the peripheral surface of the inner cap.

The second solvent passage can be prevented from being clogged with the viscous liquid by adapting the opening formed in the periphery surface of the inner cap for the above second solvent passage, consequently the vaporized solvent out of the solvent-impregnation medium can pass through the solvent flowing-out means, the solvent passage formed between the opening/closing member and the inner cap, and the opening of the inner cap, and finally reach the application tip body.

The above solvent flowing-out means may comprise a through-hole formed radially almost centrally in the partition member and a cylindrical portion sliding through the through-hole, in the cylindrical portion a hole is formed via which the inner side portion of the inside of the cap body and the above solvent passage communicate with each other, and a periphery of the through-hole in the partition member is a projecting edge projecting toward the innermost portion of the inside of the cap body. Since the projecting edge of the partition member is projecting toward the innermost portion of the cap body, even when the cap is attached to the liquid container with the open side portion of the cap body kept lower than the inner side portion thereof and the solvent in the solvent-impregnation medium is likely to move downwardly and to flow out through the hole of the cylindrical portion in the form of liquid into the open side portion away from the partition member, most solvent liquid will stay in the periphery of the projecting edge and never flow out.

The above projecting edge, formed may be an inclined face inclined toward the central axis of the cap and a flat face which is located in the above inclined face closest to the central axis of the cap and lies at right angles to the central axis, the above flat face is touchable to a flange formed on the tip of the above cylindrical portion. Since the flange and the flat face of the cylindrical portion touch with each other when the cap is attached to the liquid container, the inner side portion of the cap body can be kept sealed and the cylindrical portion can be prevented from completely slipping out from the through-hole. In addition, since an inclined face is formed on the projecting edge, when the flange of the cylindrical portion approaches to the flat face, it can be reliably induced thereto by the inclined face.

Alternatively, the above solvent flowing-out means comprises a through-hole formed radially almost centrally in the partition member, a cylindrical portion sliding through the through-hole, and a flange portion which is formed independently of the cylindrical portion and integrally connected to a tip side of the cylindrical body, in the cylindrical portion a hole is formed via which the inner side portion of the inside of the cap body and the above solvent passage communicate with each other, a periphery of the through-hole in the partition member is a projecting edge projecting toward the inner side portion of the inside of the cap body, and the above projecting edge is tightly touchable to the above flange portion. Since the cylindrical portion and the flange portion are configured independetly of each other, moldability of each of the parts can be improved and they can be easily manufactured. Since the flange portion is independent of the cylindrical portion having a hole formed on it, the flange portion can be molded in such a manner that it has no parting line formed on it, consequently it is avoidable that unexpected clearance is formed by the parting line, the clearance which is likely to cause the evaporation and flow-out of the solvent when the flange portion tightly touches the projecting portion of the partition member.

The present disclosure relates to subject matter contained in Japanese Patent Applications No. Hei 11-69311, filed on mar. 15, 1999, and No. Hei 11-225811, filed on Aug. 9, 1999, which is expressly incorporated herein by reference in its entirety

BRIEF DESCRIPTION OF THE DRAWINGS

FIG. 10(*b*) is a view taken in the direction of the arrow b of FIG. 10(*a*), and FIG. 10(*c*) is a cross-sectional view taken along a line c—c of FIG. 10(*b*);

DETAILED DESCRIPTION OF THE PREFERRED EMBODIMENTS

Figure 1:
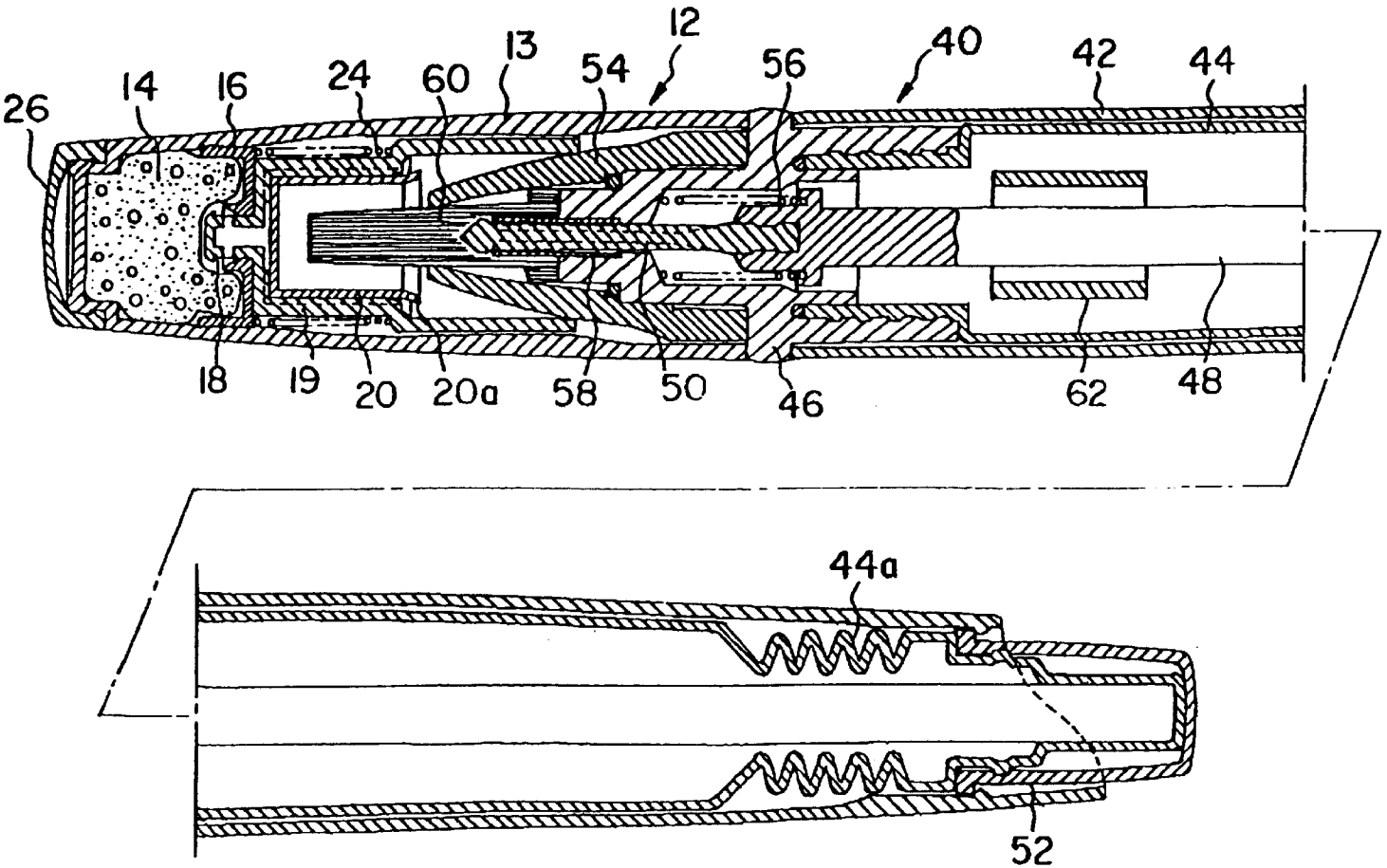
FIG. 1 is a vertical sectional view showing a first embodiment of the liquid container and cap of the present invention.

Preferred embodiments of the present invention will be illustrated with reference to the accompanying drawings.

FIGS. 1 to 6 are views showing a first embodiment of the present invention.

Referring to the drawings, reference numeral 40 denotes a liquid container which comprises: an external cylinder 42, a tank portion 44 disposed within the external cylinder 42 for receiving viscous liquid such as cosmetic nail polish, correction fluid and so on, a holder portion 46 fixed on the tip portion of the tank portion 44, a knock bar 48 lying within the tank portion 44, an induction bar 50 whose tip side penetrates the holder portion 46 and whose rear end is press-fitted onto the tip of the knock bar 48, a knock cap 52 knockably fixed to the external cylinder 42 for covering the rear end of the tank portion 44, a tip fitting 54 fixed to the holder portion 46, a spring 56 inserted between the holder portion 46 and the knock bar 48 for energizing the knock bar 48 rearward, an induction pipe 58 fixed to the holder portion 46 through which the induction bar 50 slides, and a brush 60 as an application tip body projecting from the tip fitting 54 with its base end fixed within the tip fitting 54.

Figure 6:
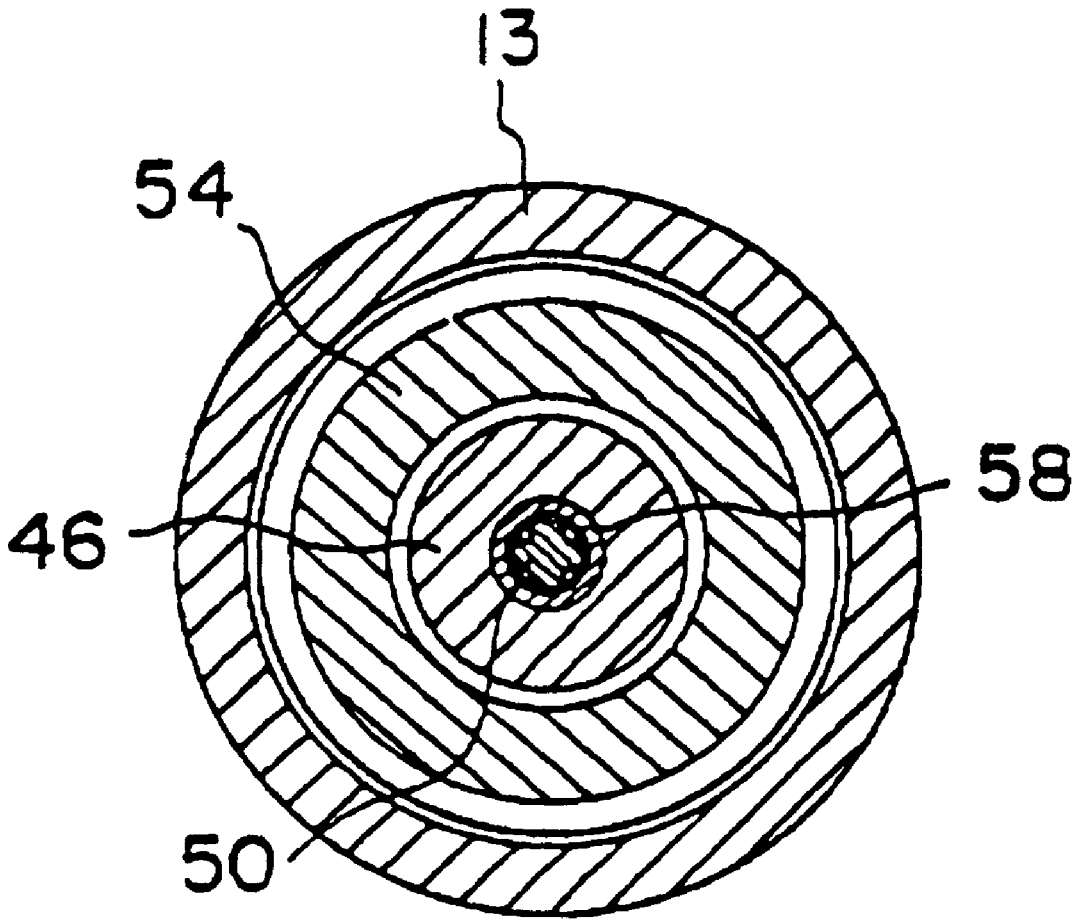
FIG. 6 is a cross-sectional view taken along a line 6–6 of FIG. 2.

At the rear end portion of the tank portion 44, formed is a bellows-shaped elastic portion 44*a*. When this liquid container 40 is used, first a cap 12 as described below is detached, and the knock cap 52 is knocked so as to push the tank portion 44, causing the above elastic portion 44*a* to shrink, as a result of which the knock bar 48 and the induction bar 50 move forward against the energizing force of the spring 56. The knock bar 48 in turn pushes the viscous liquid in the tank portion 44 into the clearances between the holder portion 46 and the induction bar 50 and between the induction pipe 58 and the induction bar 50, through which the viscous liquid is supplied to the brush 60, which makes possible the application of the liquid with the brush 60. The induction bar 50 is designed so as to have a cross-shaped section as shown in FIG. 6 in order to obtain larger clearances between the holder portion 46 and the induction bar 50 and between the induction pipe 58 and the induction bar 50, and hence the smooth flow of viscous liquid through the clearances. And on the outside of the knock bar 48, a stirring ring 62 is fitted with a play which allows the stirring ring 62 to move axially and radially within the tank portion 44 and hence to stir the viscous liquid in the tank portion 44. The outside diameter of the stirring ring 62 is the same as or less than the inside diameter of an inlet/outlet port at the tip of the tank portion 44, so that it can be assembled together with the knock bar 48 into the tank portion 44.

Reference numeral 12 denotes a cap according to the present invention adapted to be detachably attached to the tip portion of the liquid container 40 for protecting the brush 60 not in use, and reference numeral 13 denotes a cap body. In the inner side portion 13*a* of the inside of the cap body 13, there is provided a solvent-impregnation medium 14 made up of, for example, felt, cotton etc. which is impregnated with a solvent comprising the same liquid as the viscous liquid, the dilution thereof or the like.

Within the cap body 13, a partition member 16 is fixed which partitions the cap body 13 into the inner side portion 13*a* and an open side portion 13*b* and divides the solvent-impregnation medium 14 from the open side portion 13*b*. In the partition member 16 radially almost centrally formed is a through-hole 16*a* whose periphery is a projecting edge 16*b* projecting toward the inner side portion 13*a*. And inside the projecting edge 16*b*, there are formed an inclined face 16*c* inclined toward the central axis of the cap 12 and a flat face 16*d* which is located at the end of the inclined face 16*c* closest to the central axis of the cap 12 and lies in right angles to the axis.

A cylindrical portion 18 is slidably inserted into the through-hole 16*a*. The through-hole 16*a* and the cylindrical portion 18 configure a solvent-impregnation medium. In the cylindrical portion 18, formed are a transverse hole 18*b* and a longitudinal hole 18*c* whose one end communicating with the transverse hole 18*b*. A flange 18*d* formed on the projecting end of the cylindrical portion 18 is designed to be touchable to the above flat face 16*d* of the projecting edge 16*b* of the partition member 16 so that the cylindrical portion 18 cannot slip out of the partition member 16.

The cylindrical portion 18 is integrally formed together with a cylindrical opening/closing member 19 disposed on the open side portion 13*b* relative to the partition member 16. The other end of the above longitudinal hole 18*c* is in communication with the inside of the opening/closing member 19. A spring 24 as an energizing means is inserted between the opening/closing member 19 and the partition member 16 and always energizes the opening/closing member 19 away from the partition member 16, so that the cylindrical portion 18 is energized toward the open side portion 13*b* away from the partition member 16.

A plurality of ribs (four in the figure) 19*e* and 19*e*' are formed on the internal surface of the opening/closing member 19 (refer to FIGS. 3 and 4), and an inner cap 20 is fixed inside the opening/closing member 19 so that it can press-touch at the ribs 19*e* and 19*e*'. Between the internal surface of the opening/closing member 19 and the external surface of the inner cap 20 where ribs 19*e* and 19*e*' are not formed, clearance is defined which serves as a solvent passage 22 communicating with the other end of the longitudinal hole 18*c* of the above cylindrical member 18.

The flange portion 20*a* of the inner cap 20 spreads taperedly radially outwardly, and the inside space of the same is designed as a space for the brush 60 being inserted. The flange portion 20*a* configures a second solvent passage via which the external and internal surfaces of the inner cap 20 communicate with each other.

On the top portion of the cap body 13, a transparent cap 26 is mounted. And the top surface 13*c* of the cap body 13 is, for example, stained the same color as the viscous liquid received in the liquid container 40 or coated with the viscous liquid itself so that the user can recognize the color of the viscous liquid without detaching any cap 12.

Figure 5:
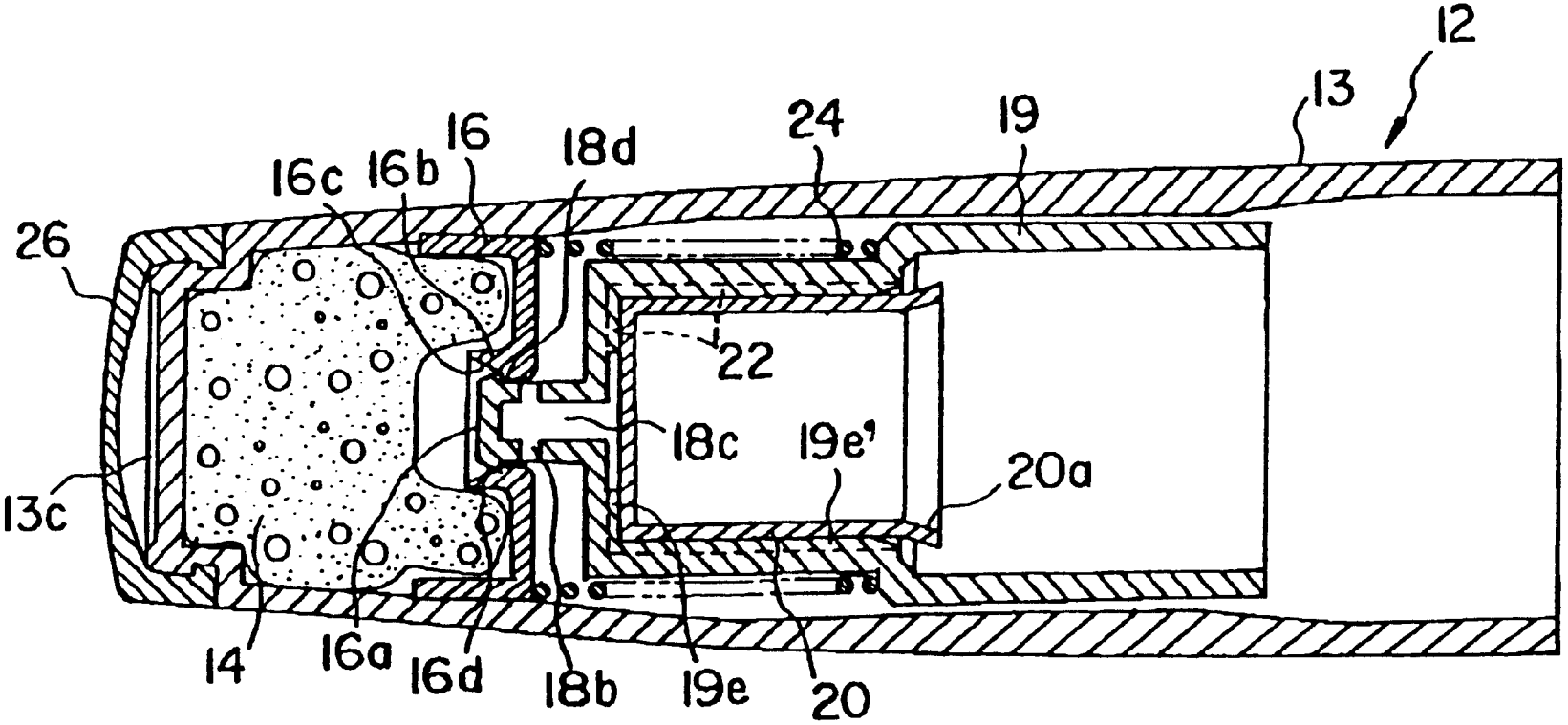
FIG. 5 is an enlarged cross-sectional view of the cap corresponding to FIG. 2 as it is not attached to the liquid container.

For the cap 12 having such a configuration as described above, when the cap 12 is detached from the liquid container 40, as shown in FIG. 5, the opening/closing member 19 is biased away from the partition member 16 by the spring 24, and the flange 18*d* of the cylindrical portion 18 touches the above flat face 16*d* of the projecting edge 16*b* of the partition member 16. At this point, the transverse hole 18*b* of the cylindrical portion 18 escapes from the inner side portion 13*a* of the cap body 13, as a result, the inner side portion 13*a* of the cap body 13 is sealed and the solvent in the solvent-impregnation medium 14 is prevented from vaporizing and flowing out.

Figure 2:
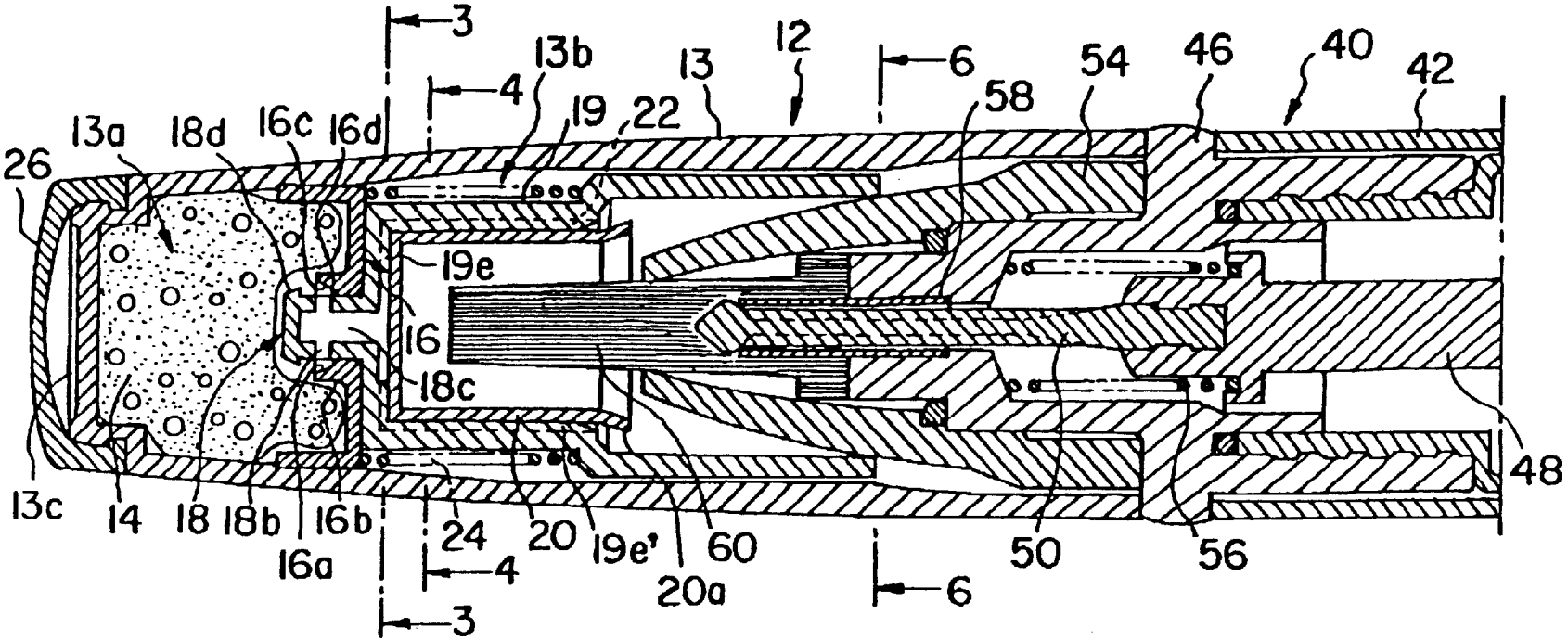
FIG. 2 is an enlarged cross-sectional view of the cap shown in FIG. 1 as it is attached to the liquid container.
Figure 3:
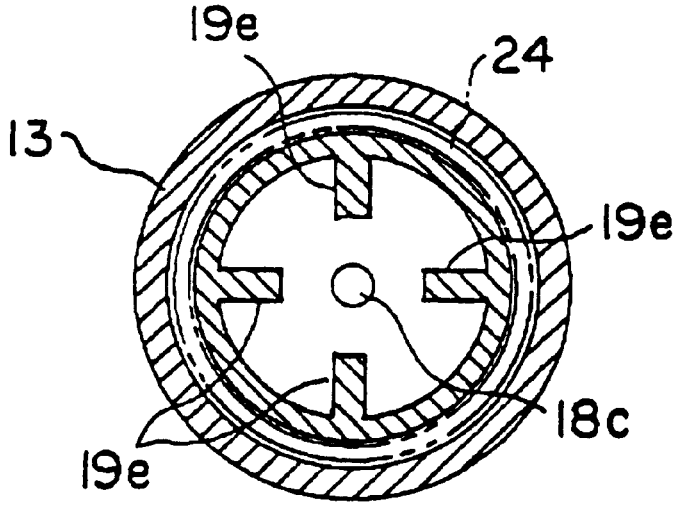
FIG. 3 is a cross-sectional view taken along a line 3–3 of FIG. 2.
Figure 4:
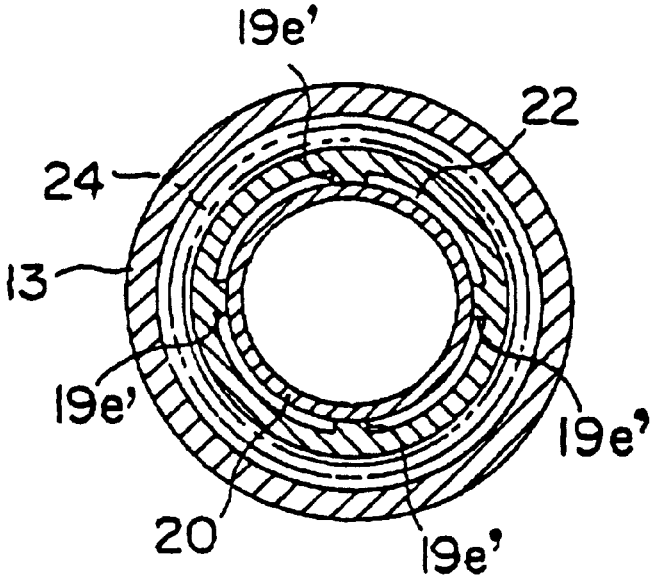
FIG. 4 is a cross-sectional view taken along a line 4–4 of FIG. 2.

When the cap 12 is attached to the liquid container 40, since the tip of the brush 60 of the liquid container 40 is inserted into the inside space of the inner cap 20 and the tip fitting 54 of the liquid container 40 pushes the opening/closing member 19 toward the inner side portion 13*a* of the cap body 13 against the energizing force of the spring 24, as shown in FIG. 2, the transverse hole 18*b* of the cylindrical portion 18 communicates with the inner side portion 13*a* of the cap body 13, which allows the vaporized solvent out of the solvent-impregnation medium 14 to pass through the transverse hole 18*b*, the longitudinal hole 18*c* and the solvent passage 22, and around the flange portion 20*a* of the inner cap 20, thus the solvent reaches the brush 60 of the liquid container 40, as a result, the brush 60 is moistened and prevented from being dried up. Even in the cases where the liquid container 40 is knocked inadvertently with the cap 12 attached thereto and the viscous liquid springs out from the brush 60, the viscous liquid will scatter within the inner cap 20 alone but never toward the flow passage of vaporized solvent, in addition, it will stick to the internal surface of the inner cap 20 and be solidified, but never blocks up the above flow passage.

When the cap 12 is attached to the liquid container 40 with the foreside portion 13*b* of the cap body 13 kept lower than the innermost portion 13*a* thereof, the solvent in the solvent-impregnation medium 14 is likely to move downwardly and to flow out through the transverse hole 18*b* in the form of liquid into the foreside portion 13*b* away from the partition member 16. However, due to the projecting edge 16*b* which projects toward the innermost portion 13*a*, most solvent liquid will stay in the periphery of the projecting edge 16*b* and never flow out.

Even if slight movement occurs radially when the cylindrical portion 18 slides through the through-hole 16*a*, since on the projecting edge 16*b* an inclined face 16*c* is formed through which the displacement can be corrected, the flange 18*d* of the cylindrical portion 18 can be reliably induced toward the flat face 16*d*.

Further, since the flange portion 20*a* of the inner cap 20 spreads radially outwardly, when the cap 12 is attached to the liquid container 40, the flange portion 20*a* is prevented from interfering with the brush 60 and the brush 60 is prevented from being damaged. If there is unlikely to occur interference with the brush or the application tip body, the flange portion 20*a* is not necessarily spread radially outwardly.

FIGS. 7 to 12 are views showing a second embodiment of the present invention.

Referring to the drawings, reference numeral 140 denotes a liquid container which comprises: an external cylinder 142 which serves as a bank portion for receiving viscous liquid such as cosmetic nail polish, correction fluid and so on, a tip fitting 144 fixed to the tip of the external cylinder 142, a knock bar 148 which lies within the external cylinder 142, an induction bar 150 whose rear end is press-fitted into the tip of the knock bar 148 while its tip side penetrating the external cylinder 142, a tail stopper 152 fixed to the rear end of the external cylinder 142, a rear ring 154 fitted onto the rear end of the tail stopper 152, a bellows-shaped elastic body 156 sandwiched between the tail stopper 152 and the rear ring 154, a knock cap 158 which can knock against the external cylinder 142 and covers the rear end of the elastic body 156, a spring 160 inserted between a shelf surface inside of the external cylinder 142 and the knock bar 148 to energize the knock bar 148 rearward, a brush 162 as an application tip body projecting from the tip fitting 144 with its base end fixed therein, and a stirring body 164 freely movable within the external cylinder 142.

Polyamide resins or polyacrylonitrile-based thermoplastic resins can be used for the parts, such as the external cylinder 142, the knock bar 148 and the tail stopper 152, which directly contact with the viscous liquid.

The tail stopper 152, the rear ring 154 and the elastic body 156 configure a unit which can be previously assembled in such a manner that the rear ring 154 is fitted onto the rear stopper 152 with the tip of the elastic body 156 sandwiched therebetween. The unit may also be configured in such a manner that the knock cap 158 is engaged with the rear ring 154. The whole assembly operation of the liquid container 140 is such that the knock bar 148, the induction bar 150 and the spring 160 are inserted in the external cylinder 142, the brush 162 and the tip fitting 144 are fixed to the tip of the external cylinder 142, followed by attaching a cap 112 described below. Then the external cylinder 142 is filled with viscous liquid from its rear side in state where it is raised straight with the cap 112 kept downward, and the unit previously configured of the tail stopper 152, the rear ring 154 and the elastic body 156 is press-fitted into the external cylinder 142 from its rear side.

Figure 12:
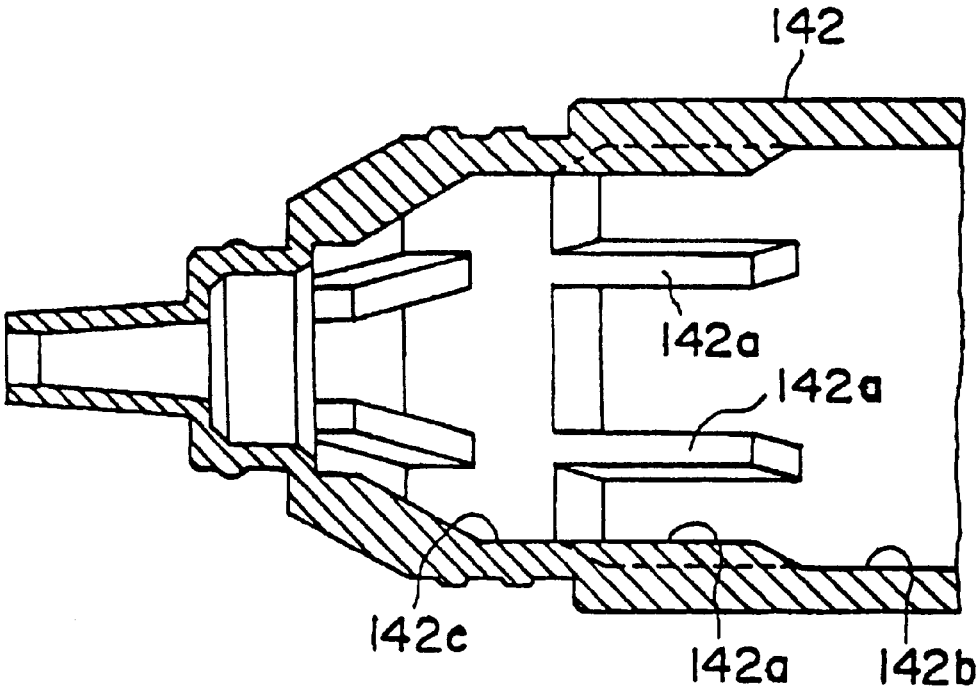
FIG. 12 is a cross-sectional view of the tip portion of the external cylinder shown in FIG. 7.

AS illustrated in FIG. 12 in detail, in the internal periphery surface of the external cylinder 142, a plurality of ribs 142*a* are formed. The portion behind the ribs 142*a* is an diameter-enlarging portion 142*b* where the inside diameter of the external cylinder 142 is enlarged, and the portion ahead of the ribs 142*a* is a diameter-reducing portion 142*c* where the inside diameter of the external cylinder 142 is reduced, whose internal surface is at the same level as and continuous with the ribs 142*a*, is smaller than the diameter-enlarging portion 142*b*. And on the tip of the above knock bar 148, formed is an diameter-enlarging portion 148*a* whose outside diameter is almost the same as that of the diameter-reducing portion 142*c*. The diameter-enlarging portion 148*a* of the above knock bar 148 which is energized backward by the energizing force of the spring 160 is always located at point where ribs 142*a* are formed slightly behind them.

When this liquid container 140 is used, first a cap 112 as described below is detached, and the knock cap 158 is knocked so as to shrink the above elastic body 156, which causes the knock bar 148 and the induction bar 150 to move forward against the energizing force of the spring 160. This in turn causes the diameter-enlarging portion 148*a* of the knock bar 148 to move forward slidably contacting the ribs 142*a* of the external cylinder 142 and the diameter-reducing portion 142*c* as well. As a result, a sealed room is formed in the diameter-reducing portion 142*c* between the knock bar 148 and/or the induction bar 150 and the diameter-reducing portion 142*c*, and the viscous liquid in the above sealed room is pushed forth by pumping action, flows out from the external cylinder 142 with the advance of the induction bar 150, and is supplied to the brush 162. This makes possible application of the viscous liquid with the brush 162.

By the way, if the knock cap 158 is inadvertently knocked when the liquid container is not being used, the viscous liquid is likely to spring out from the brush 162 unexpectedly and undesirably. However, the design of liquid container is such that, since the knock bar 148 slidably contacts with the ribs 142*a* of the external cylinder 142 in the early stage of knocking, no sealed room is formed between the external cylinder 142 and the knock bar 148 and/or the induction bar 150, and hence preventing of the viscous liquid from being unexpectedly discharged from the brush 162. Since ribs 142*a* are provided, the knock bar 148 can move steadily axially while slidably touching the top of them, in addition, if the length of the ribs 142*a* is properly set, the play before the pumping action starts can be adjusted.

Reference numeral 112 denotes a cap according to the present invention which is adapted to be detachably attached to the tip portion of the liquid container 140 to protect the brush 162 not in use, and reference numeral 113 denotes a cap body. In an inner side portion 113*a* of the cap body 113, there is provided a solvent-impregnation medium 114 made up of, for example, felt and cotton which is impregnated with a solvent comprising the same liquid as the viscous liquid, the dilution thereof or the like.

There is fixed a partition member 116 within the cap body 113 which partitions the cap body 113 into the inner side portion 113*a* and the open side portion 113*b* and divides the solvent-impregnation medium 114 from an open side portion 113*b*. There is formed radially and almost centrally a through-hole 116*a* in the partition member 116 the periphery of which is a projecting edge 116*b* projecting toward the innermost portion 113*a*. And there are formed an inclined face 116*c* inclined toward the central axis of the cap 112 and a flat face 116*d* which is located at the end of the inclined face 116*c* closest to the central axis and lies in right angles to the central axis of the cap 112.

A cylindrical portion 118 is slidably inserted into the through-hole 116*a* and a flange portion 117 which is formed independently of the cylindrical portion 118 is press-fitted integrally into the tip side of the cylindrical portion 118. The through-hole 116*a*, the cylindrical portion 118 and the flange portion 117 configure a solvent-impregnation medium. There are formed a transverse hole 118*b* and a longitudinal hole 118*c* whose one end is in communication with the above transverse hole 118*b* in the cylindrical portion 118. The longitudinal hole 118*c* is in the form of ellipse which is circle some parts of which are cut, and the flange portion 117 has a projecting portion 117*a* whose cross section is in the form of ellipse (refer to FIG. 10(*b*)) corresponding to the shape of the longitudinal hole 118*c* so that it can be press-fitted thereinto. And there is formed a communication groove 117*b* communicating with the transverse hole 118*b* longitudinally along the projecting portion 117*a*.

The flange portion 117 is designed to be tightly touchable at the above flat face 116*d* of the projecting edge 116*b* of the partition member 116 so that the cylindrical portion 118 integrally connected to the flange portion 117 cannot slip out of the partition member 116.

The cylindrical portion 118 is integrally formed together with a cylindrical opening/closing member 119 disposed on the open side portion 113*b* relative to the partition member 116. The other end of the above longitudinal hole 118*c* is in communication with the inside of the opening/closing member 119. A spring 124 as an energizing means is inserted between the opening/closing member 119 and the partition member 116 and always energizes the opening/closing member 119 away from the partition member 116, so that the cylindrical portion 118 can be energized toward the open side portion 113*b* away from the partition member 116.

Figure 11:
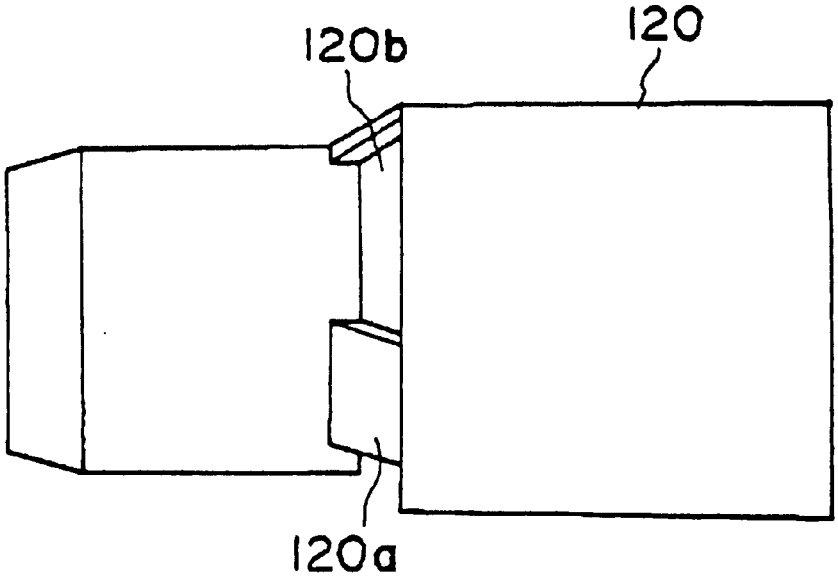
FIG. 11 is a side view of the inner cap.

A plurality of ribs 119*e* and 119*e*' are formed on the interior surface of the opening/closing member 119 (refer to FIG. 9), and an inner cap 120 is fixed inside the opening/closing member 119 in such a manner that it press-touches at the ribs 119*e* and 119*e*'. Between the interior surface of the opening/closing member 119 and the exterior surface of the inner cap 120 where ribs 119*e* and 119*e*' are not formed defined is clearance which serves as a solvent passage 122 in communication with the passage formed of the longitudinal hole 118*c* of the above cylindrical member 118 and the communication groove 117*b* formed in the above flange portion 117. As shown in FIG. 11, a taper portion 120*a* spreading radially outwardly is formed longitudinally centrally in the inner cap 120, and on the taper portion 120*a* a plurality of openings 120*b* are formed separatedly in the circumferential direction in such a manner that they configure a second solvent passage via which the external and internal surfaces of the inner cap 120 communicates with each other. The inside space of the inner cap 120 is designed as a space for the brush 162 being inserted.

The whole cap 112 having such a constitution as described above can be assembled by previously forming the parts except the cap body 113, that is, the solvent-impregnation medium 114, the partition member 116, the flange portion 117, the cylindrical portion 118, the opening/closing member 119 and the inner cap 120 into a unit and pressing the unit into the cap body 113.

For the cap 112 of this embodiment, like the cap of the first embodiment, when the cap 112 is detached from the liquid container 140, the opening/closing member 119 is biased away from the partition member 116 by the spring 124, and the flange portion 117 tightly touches the above flat face 116*d* of the projecting edge 116*b* of the partition member 116. At this point, the transverse hole 118*b* of the cylindrical portion 118 escapes from the inner side portion 113*a* of the cap body 113, as a result, the inner side portion 113*a* of the cap body 113 is sealed and the solvent in the solvent-impregnation medium 114 is prevented from vaporizing and flowing out.

Figure 7:
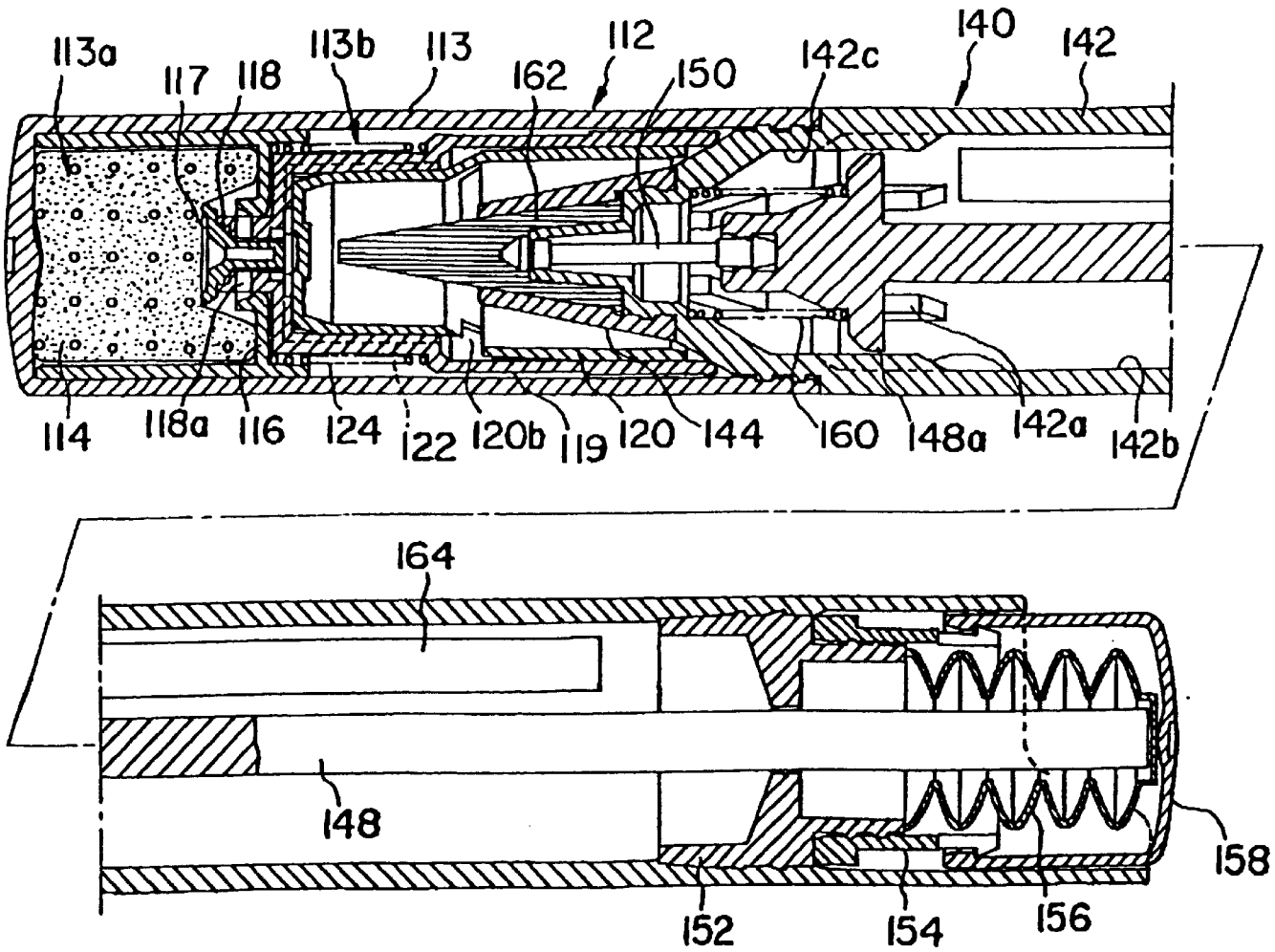
FIG. 7 is a vertical sectional view showing a second embodiment of the liquid container and cap of the present invention.
Figure 8:
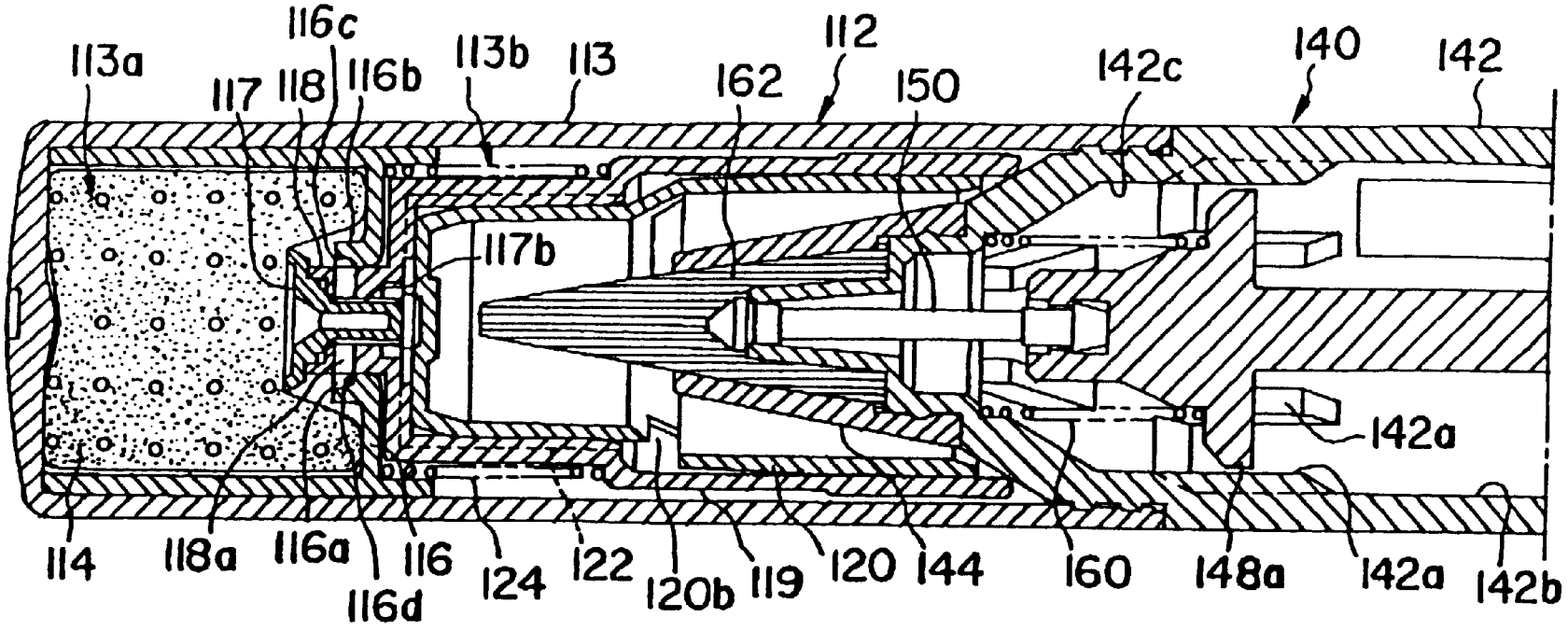
FIG. 8 is an enlarged cross-sectional view of the cap shown in FIG. 7 as it is attached to the liquid container.
Figure 9:
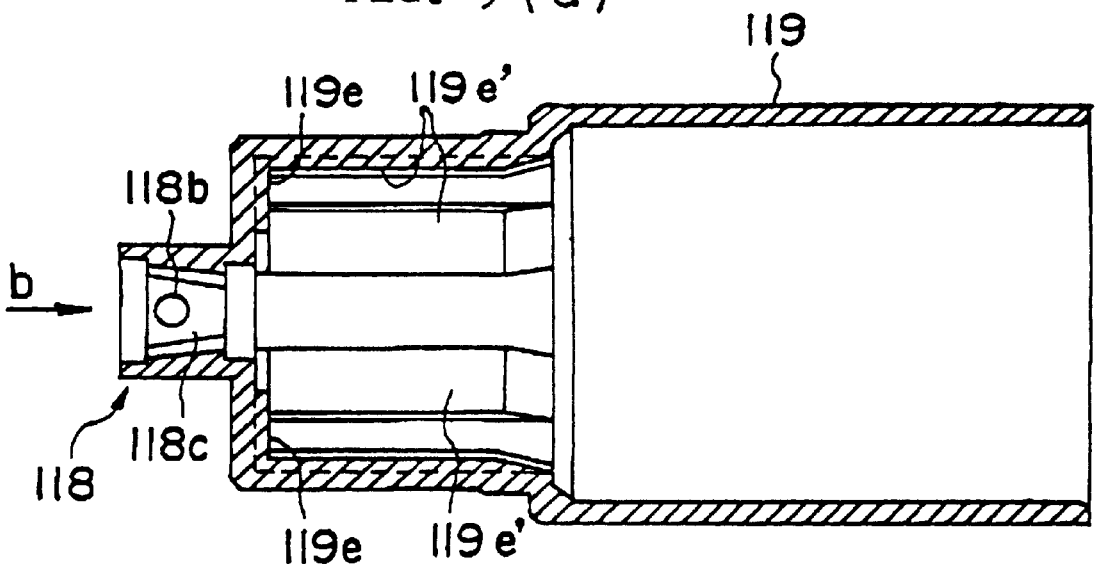
FIG. 9(*a*) is a cross-sectional view of the opening/closing member and the cylindrical portion shown in FIG. 7, and FIG. 9(*b*) is a view taken in the direction of an arrow b of FIG. 9(*a*)
Figure 9:
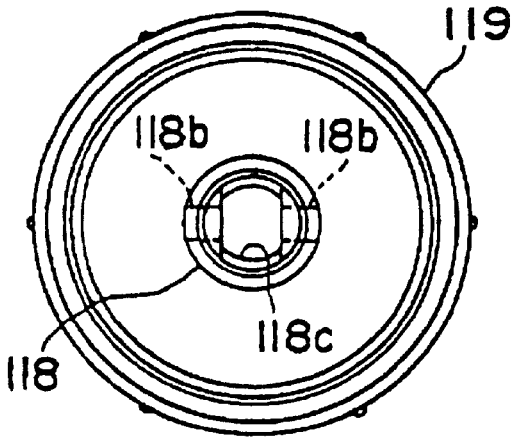
Figure 10:
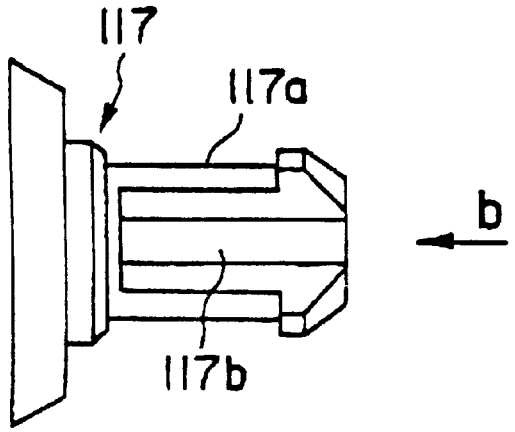
FIG. 10(*a*) is a side view of the flange portion shown in FIG. 7.
Figure 10:
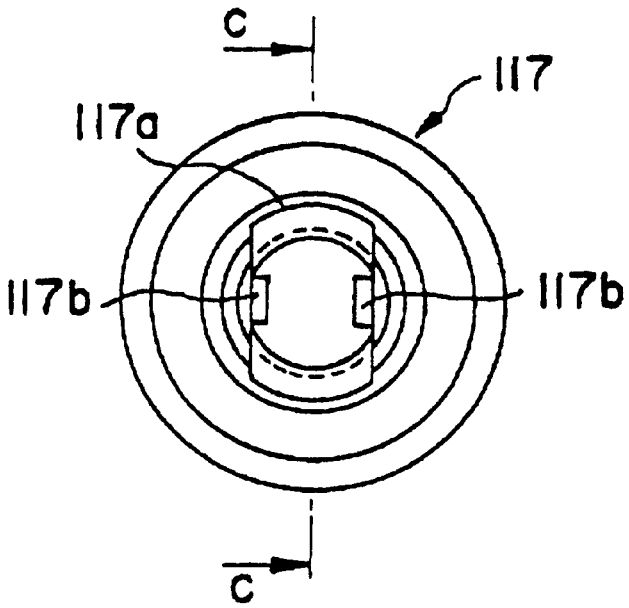
Figure 10:
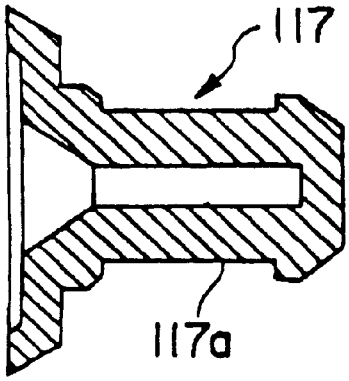

When the cap 112 is attached to the liquid container 140, since the tip of the brush 162 of the liquid container 140 is inserted into the inside space of the inner cap 120 and the external cylinder 142 of the liquid container 140 pushes the opening/closing member 119 toward the inner side portion 113*a* of the cap body 113 against the energizing force of the spring 124, as shown in FIG. 7, the transverse hole 118*b* of the cylindrical portion 118 communicates with the inner side portion 113*a* of the cap body 113, which allows the vaporized solvent out of the solvent-impregnation medium 114 to pass through the transverse hole 118*b*, the passage made up of the longitudinal hole 118*c* and the communication groove 117*b*, the solvent passage 122, and the openings 120*b* of the inner cap 120 and to reach the brush 162 of the liquid container 140, as a result of which the brush 162 is moistened and prevented from being dried up. Even if the liquid container 140 is knocked inadvertently with the cap 112 attached to the liquid container 140, causing the diameter-enlarging portion 148*a* of the above knock bar 148 to move from the ribs 142*a* to the diameter-reducing portion 142*c*, as a result of which the viscous liquid springs out from the brush 162, the viscous liquid will scatter only within the inner cap 120, but the openings 120*b* of the inner cap 120 will never be blocked up since they are located near the base portion of the brush 262 which is hard for the scattered viscous liquid to reach. In addition, as the openings 120*b* can be designed to have a larger area of, they will never be blocked up. Thus the viscous liquid will stick to the internal surface of the inner cap 120 and be solidified, but it will never block up the above solvent passage 122.

Since the flange portion 117 is configured as a separate component of the cylindrical portion 118, when the flange portion 117 is molded, it is possible to mold the flange portion 117 in unsplit mold without being affected by the shape of the cylindrical portion 118 formed with the transverse hole 118*b*. Thereby, since there doesn't occur any parting line on the outer surface of the flange portion 117, when the flange portion 117 touches the flat face 116*d* of the portion member 116, there can be prevented such a situation that any unintended gap is formed caused by the existence of the parting line to raise evaporating outflow of the solvent.

Furthermore, when the cap 112 is attached to the liquid container 140 with the open side portion 113*b* of the cap body 113 kept lower than the inner side portion 113*a* thereof, the solvent in the solvent-impregnation medium 114 is likely to move downwardly and to flow out through the transverse hole 118*b* in the form of liquid into the open side portion 113*b* away from the partition member 116. However, due to the projecting edge 16*b* which projects toward the inner side portion 113*a*, most solvent liquid will stay in the periphery of the projecting edge 116*b* and never flow out.

If slight movement occurs radially when the cylindrical portion 118 integrated with the flange portion 117 slides through the through-hole 116*a*, since the projecting edge 116*b* has an inclined face 116*c* formed on it through which the displacement can be corrected, the flange portion 117 can be reliably induced toward the flat face 116*d*.

Further, since the taper portion 120*a* of the inner cap 120 spreads radially outwardly, when the cap 112 is attached to the liquid container 140, the taper portion 120*a* is prevented from interfering with the brush 162 and the blush 162 is prevented from being damaged.

In the embodiments described above, the brushes 60 and 162 were taken for example of an application tip body, however the invention is not intended to be limited to the specific embodiments, and even a thin tube or stick-shaped body is applicable.

Figure 13:
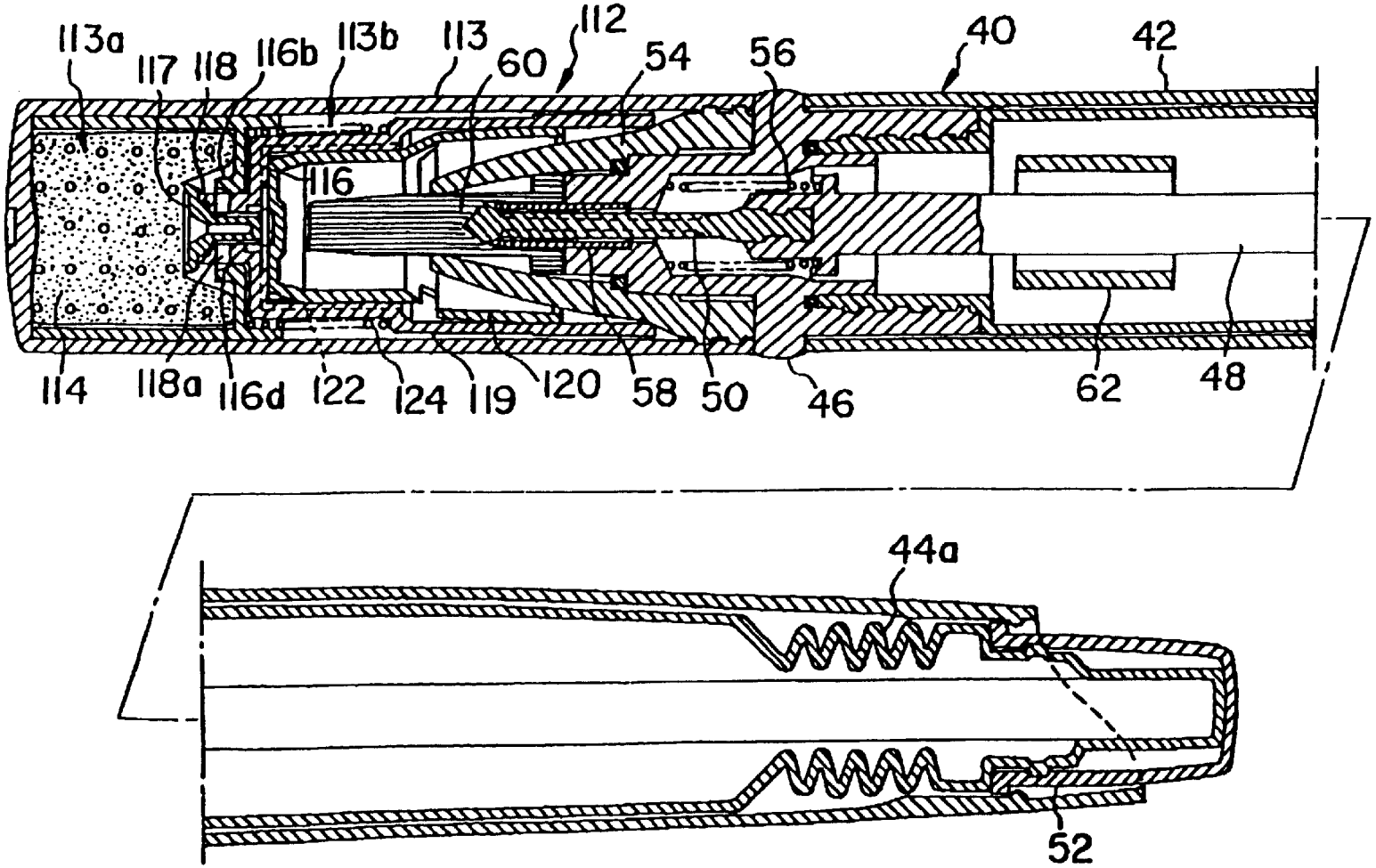
FIG. 13 is a vertical sectional view showing a third embodiment of the liquid container and cap of the present invention.

FIG. 13 is a view showing a third embodiment of the present invention in which the cap 112 described in the second embodiment is attached to the liquid container 40 described in the first embodiment.

Even in the third embodiment, the same effect as described in the preceding embodiments are obtained.

As described above, according to the present invention, when the cap is detached from the liquid container, since the energizing means works to bias the opening/closing member in such a direction as to close the solvent flowing-out means, the solvent can be prevented from vaporizing and flowing out of the solvent-impregnation medium. On the other hand, when the cap is attached to the liquid container, since the liquid container pushes the above opening/closing member in such a direction as to open the above solvent flowing-out means, the vaporized solvent out of the solvent-impregnation medium is allowed to pass through the solvent flowing-out means, the solvent passage defined between the opening/closing member and the inner cap, and the second solvent passage defined between the external and internal surfaces of the inner cap, so as to reach the application tip body, as a result of which the application tip body can be moistened and prevented from being dried up. In addition, since the application tip body is inserted into the inner cap, the viscous liquid having sprung out from the application tip body may scatter mostly within the inner cap, but will never reach the solvent flowing-out means nor the solvent passage, never clog them, and therefore, the supply of the vaporized solvent is never obstructed. The second solvent passage can be prevented from being clogged with the viscous liquid having sprung out from the application tip body by increasing its cross-sectional area or by locating it to the liquid container side away from the base portion of the application tip body.

What is claimed is:

1. A liquid container cap adapted to be detachably attached to a tip portion of a liquid container which stores viscous liquid and has on its tip an application tip body for applying the viscous liquid, and designed to protect the above application tip body, comprising:

a cap body, a solvent-impregnation medium impregnated with a solvent and housed in an inner side portion of an inside of the cap body for preventing the above application tip body from being dried up, a partition member fixed within the cap body for dividing the above solvent-impregnation medium from an open side portion of the cap body, a solvent flowing-out means provided radially almost centrally in the above partition member for letting vaporized solvent out of the solvent-impregnation medium flow out, opening/closing member disposed within the open side portion of the cap body for opening/closing the above solvent flowing-out means, an energizing means for always energizing the opening/closing means in such a direction as to close the solvent flowing-out means, and an inner cap fixed inside said opening/closing member, wherein a solvent passage for letting the vaporized solvent from the above solvent flowing-out means pass therethrough is defined between an external surface of said inner cap and an internal surface of said opening/closing member, further a second solvent passage via which said solvent passage and said application tip body communicate with each other is formed between the external and internal surfaces of the inner cap, and when the cap is attached to the liquid container, the liquid container biases the above opening/closing member in such a direction as to open said solvent flowing-out means, while said application tip body being inserted into said inner cap, as a result of which the vaporized solvent out of the solvent-impregnation medium is allowed to pass through the solvent flowing-out means, said solvent passage and said second solvent passage, so as to reach the application tip body.

2. The liquid container cap according to claim 1, wherein the second solvent passage is a periphery of a flange portion of the inner cap.

3. The liquid container cap according to claim 2, wherein the solvent flowing-out means comprises a through-hole formed radially almost centrally in the partition member and a cylindrical portion sliding through the through-hole, in the cylindrical portion a hole being formed via which the inner side portion of the inside of the cap body and the solvent passage communicate with each other, and a periphery of the through-hole in the partition member being a projecting edge projecting toward the inner side portion of the inside of the cap body.

4. The liquid container cap according to claim 2, wherein the solvent flowing-out means comprises a through-hole formed radially almost centrally in the partition member, a cylindrical portion sliding through the through-hole, and a flange portion which is formed independently of the cylindrical portion and integrally connected to a tip side of the cylindrical portion, in the cylindrical portion a hole is formed via which the inner side portion of the inside of the cap body and the solvent passage communicate with each other, a periphery of the through-hole in the partition member is a projecting edge projecting toward the inner side portion of the inside of the cap body, and the projecting edge is tightly touchable to the flange portion.

5. The liquid container cap according to claim 2, wherein the flange portion of the above inner cap spreads radially outwardly.

6. The liquid container cap according to claim 5, wherein the solvent flowing-out means comprises a through-hole formed radially almost centrally in the partition member and a cylindrical portion sliding through the through-hole, in the cylindrical portion a hole being formed via which the inner side portion of the inside of the cap body and the solvent passage communicate with each other, and a periphery of the through-hole in the partition member being a projecting edge projecting toward the inner side portion of the inside of the cap body.

7. The liquid container cap according to claim 5, wherein the solvent flowing-out means comprises a through-hole formed radially almost centrally in the partition member, a cylindrical portion sliding through the through-hole, and a flange portion which is formed independently of the cylindrical portion and integrally connected to a tip side of the cylindrical portion, in the cylindrical portion a hole is formed via which the inner side portion of the inside of the cap body and the solvent passage communicate with each other, a periphery of the through-hole in the partition member is a projecting edge projecting toward the inner side portion of the inside of the cap body, and the projecting edge is tightly touchable to the flange portion.

8. The liquid container cap according to claim 1, wherein the second solvent passage is an opening formed in a peripheral surface of the inner cap.

9. The liquid container cap according to claim 8, wherein the solvent flowing-out means comprises a through-hole formed radially almost centrally in the partition member and a cylindrical portion sliding through the through-hole, in the cylindrical portion a hole being formed via which the inner side portion of the inside of the cap body and the solvent passage communicate with each other, and a periphery of the through-hole in the partition member being a projecting edge projecting toward the inner side portion of the inside of the cap body.

10. The liquid container cap according to claim 8, wherein the solvent flowing-out means comprises a through-hole formed radially almost centrally in the partition member, a cylindrical portion sliding through the through-hole, and a flange portion which is formed independently of the cylindrical portion and integrally connected to a tip side of the cylindrical portion, in the cylindrical portion a hole is formed via which the inner side portion of the inside of the cap body and the solvent passage communicate with each other, a periphery of the through-hole in the partition member is a projecting edge projecting toward the inner side portion of the inside of the cap body, and the projecting edge is tightly touchable to the flange portion.

11. The liquid container cap according to claim 1, wherein the solvent flowing-out means comprises a through-hole formed radially almost centrally in the partition member and a cylindrical portion sliding through the through-hole, in the cylindrical portion a hole being formed via which the inner side portion of the inside of the cap body and the solvent passage communicate with each other, and a periphery of the through-hole in the partition member being a projecting edge projecting toward the inner side portion of the inside of the cap body.

12.The liquid container cap according to claim 11, wherein in the projecting edge, formed are an inclined face inclined toward the central axis of the cap and a flat face which is located at an end of the inclined face closest to the axis of the cap and lies at right angles to the axis, the flat face is touchable to a flange formed on the tip of the above cylindrical portion.

13. The liquid container cap claim 1, wherein the solvent flowing-out means comprises a through-hole formed radially almost centrally in the partition member, a cylindrical portion sliding through the through-hole, and a flange portion which is formed independently of the cylindrical portion and integrally connected to a tip side of the cylindrical portion, in the cylindrical portion a hole is formed via which the inner side portion of the inside of the cap body and the solvent passage communicate with each other, a periphery of the through-hole in the partition member is a projecting edge projecting toward the inner side portion of the inside of the cap body, and the projecting edge is tightly touchable to the flange portion.

* * * * *